US007704056B2

(12) United States Patent
Masoudipour et al.

(10) Patent No.: US 7,704,056 B2
(45) Date of Patent: Apr. 27, 2010

(54) TWO-STAGE VAPOR CYCLE COMPRESSOR

(75) Inventors: Mike M. Masoudipour, Rancho Palos Verdes, CA (US); Allen Hansen, Anaheim, CA (US); Chris Speights, Long Beach, CA (US); Phung K. Duong, Long Beach, CA (US); Zeng Qian, Torrance, CA (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 12/234,517

(22) Filed: Sep. 19, 2008

(65) Prior Publication Data

US 2009/0044548 A1 Feb. 19, 2009

Related U.S. Application Data

(63) Continuation-in-part of application No. 11/677,189, filed on Feb. 21, 2007.

(51) Int. Cl.
*F04B 39/06* (2006.01)
*F04B 39/02* (2006.01)
*F25B 31/00* (2006.01)

(52) U.S. Cl. ..... 417/372; 417/367; 62/505

(58) Field of Classification Search ..... 62/505; 417/366, 369, 372, 373
See application file for complete search history.

(56) References Cited

U.S. PATENT DOCUMENTS 1,418,704 A 6/1922 Green
2,542,016 A 2/1951 Else et al.
2,621,601 A 12/1952 Stout
2,888,193 A 5/1959 Greenwald
3,022,739 A * 2/1962 Herrick et al. ..... 417/369
3,853,433 A 12/1974 Roberts et al.
3,975,117 A 8/1976 Carter
4,334,830 A * 6/1982 Haavik ..... 417/68
4,770,606 A 9/1988 Kuroiwa
4,903,497 A * 2/1990 Zimmern et al. ..... 62/113
5,659,214 A 8/1997 Guardiani et al.
5,795,138 A * 8/1998 Gozdawa ..... 417/243
5,797,731 A 8/1998 Kobayashi et al.
5,857,348 A 1/1999 Conry
6,068,457 A 5/2000 Dewhirst
6,102,672 A * 8/2000 Woollenweber et al. ..... 417/366
6,355,995 B1 * 3/2002 Jeppesen ..... 310/52

(Continued)

*Primary Examiner*—William E. Tapolcai
*Assistant Examiner*—Filip Zec
(74) *Attorney, Agent, or Firm*—Oral Caglar, Esq.

(57) ABSTRACT

A two-stage vapor cycle compressor includes a first stage impeller, a second stage impeller situated adjacent to the first stage impeller, an electric motor running on a pair of foil bearings, a thrust disk including two foil bearings and being positioned between the second stage impeller and the electric motor, and a compressor housing enclosing the first and second stage impeller and the electric motor. A refrigerant vapor compressed by the first stage and second stage impeller flows through an internal passageway formed by the compressor housing and cools the foil bearings and the electric motor. The compressor may be a gravity insensitive, small, and lightweight machine that may be easily assembled at low manufacturing costs. The two-stage vapor cycle compressor may be suitable for, but not limited to, applications in vapor compression refrigeration systems, such as air-conditioning systems, for example, in the aircraft and aerospace industries.

14 Claims, 7 Drawing Sheets

U.S. PATENT DOCUMENTS 6,443,711 B1 * 9/2002 Miller, Jr. ..... 417/372
6,564,560 B2 5/2003 Butterworth et al.
6,854,517 B2 * 2/2005 Gay et al. ..... 166/369
6,997,686 B2 2/2006 Agrawal et al.

* cited by examiner

TWO-STAGE VAPOR CYCLE COMPRESSOR

CROSS-REFERENCES TO RELATED APPLICATIONS

This patent application is a continuation-in-part of U.S. patent application Ser. No. 11/677,189, filed Feb. 21, 2007, and entitled "Two-Stage Vapor Cycle Compressor," currently pending.

BACKGROUND OF THE INVENTION

The present invention generally relates to vapor cycle compressors and, more particularly, to a low cost two-stage vapor cycle compressor and a method for operating an electrically driven two-stage vapor cycle compressor.

Vapor compression refrigeration is a refrigeration method that is widely used for air-conditioning spaces, for example, public spaces such as private and public buildings, automobiles, and aircraft cabins, or for domestic or commercial refrigerators and other commercial and industrial services. Vapor-compression refrigerant systems typically circulate a liquid refrigerant as a medium that absorbs and removes heat from the space to be cooled and subsequently rejects that heat elsewhere. Vapor-compression refrigerant systems typically include a compressor, a condenser, a throttle or expansion valve, and an evaporator. The circulating refrigerant enters the compressor in a thermodynamic state known as superheated vapor, which has a low pressure and a low temperature, and is compressed to a higher pressure, resulting in a higher temperature as well. The hot vapor is routed through a condenser where it is cooled and condensed into a liquid. The liquid refrigerant is routed through the expansion valve to the evaporator, where the refrigerant absorbs and removes heat from air circulating through the evaporator and goes over into the superheated vapor state. To complete the refrigeration cycle, the refrigerant in vapor form is routed back to the compressor. Consequently, the main purpose of the compressor is to boost the pressure of the refrigerant in vapor form so that the refrigerant cycle can be completed.

A typical two-stage vapor cycle compressor includes two impellers to realize two stages of compression. Industries, and especially the aerospace industry, typically strive for vapor cycle compressors that have a high reliability and long life span, that have a compact size, are easy to assemble, and can be manufactured at a low cost while operating highly efficiently. U.S. Pat. No. 6,564,560, for example, utilizes ceramic roller element bearings to achieve an oil-free liquid chiller. Still, the roller element bearings have to be actively lubricated by liquid refrigerant.

U.S. Pat. No. 5,857,348, for example, utilizes non-lubricated radial bearings, such as magnetic or foil gas bearings cooled with refrigerant in vapor form, as journal bearings. First and second stage impellers are mounted on opposite ends of a drive shaft driven by a high-speed brushless DC (continuous current) permanent magnet motor. This layout may not allow a compact design of the compressor. The arrangement of the compressor components on the drive shaft and the use of return channels and guide vanes may not enable the most efficient cooling method for the air bearings and the motor but may increase the number of parts used in the assembly of the compressor.

U.S. Pat. No. 6,997,686, for example, teaches a two-stage compressor including a first impeller and a second impeller connected in series by a transition pipe and using a low-pressure refrigerant, such as R134a. Foil gas bearings are used in combination with an induction motor running at high speeds. An encoder disc is included to sense the rotational speed of the rotating assembly of the compressor. The compressor housing includes a separate cooling inlet and outlet for circulating liquid refrigerant in an inner cooling jacket. O-rings are used to seal the cooling jacket within the compressor housing.

As can be seen, there is a need for a two-stage vapor cycle compressor that has a simple design including a reduced number of parts and interfaces compared to prior art compressors and that can be manufactured at a relatively low cost by taking advantage of modern high volume production techniques. Furthermore, there is a need for a method that optimizes the flow cooling the bearings and the motor to increase the efficiency of the compressor compared to prior art compressors.

SUMMARY OF THE INVENTION

In one aspect of the present invention, a two-stage vapor cycle compressor comprises a first stage impeller with a first stage impeller inlet receiving a refrigerant vapor for compression and a first stage impeller outlet proving a compressed refrigerant vapor; a first stage diffuser, a second stage impeller with a second stage impeller inlet receiving the compressed refrigerant vapor from the first stage impeller outlet for further compression and a second stage impeller outlet, a second stage diffuser; an electric motor running on a journal bearing, where the electric motor drives the first stage impeller and the second stage impeller; a thrust disk with a thrust bearing and a compressor housing enclosing the first stage impeller, the second stage impeller, and the electric motor, the compressor housing with a compressor inlet receiving the refrigerant vapor and directing the refrigerant vapor to the first stage impeller inlet, the compressor housing having a passage to direct a fraction of the compressed refrigerant vapor from the second stage impeller outlet to cool the electric motor, the thrust bearing, and the journal bearing, the compressor housing having a scroll and an outlet to collect compressed vapor from the second stage diffuser. The compressor may have a forward end and an aft end, so that the first and second stage impellers may be situated at the front end. The thrust bearing may be situated either at the aft end or at the front end between the impellers and the motor. The motor may be cooled by a cooling jacket consisting of either a sleeve surrounding the motor or a helical groove formed in an inner surface of the compressor housing so that the helical groove surrounds the motor.

In another aspect of the present invention, a passageway of a two-stage vapor cycle compressor having a forward end and an aft end is comprised of a compression loop, a forward cooling loop, and an aft cooling loop. The compression loop may be employed to compress refrigerant vapor entering the forward end by the use of a first stage impeller and the second stage impeller. If the compressor has a thrust disk positioned between a motor and the impellers at the forward end of the compressor, then a forward cooling may receive a first portion of said refrigerant vapor from the compression loop and direct the first portion to flow over the thrust bearing and a forward journal bearing, and an aft cooling loop may receive a second portion of the refrigerant vapor from the compression loop and direct the second portion to flow through a rotor bore of a motor rotor and an aft journal bearing. The thrust bearing, the forward journal bearing, and the aft journal bearing are foil bearings. If the compressor has a thrust disk positioned at the aft end of the compressor, then a forward cooling loop may receive a first portion of said refrigerant vapor from the compression loop and direct the first portion to flow over a forward journal bearing, and an aft cooling loop may receive a second portion of the refrigerant vapor from the compression loop and direct the second portion to flow through a rotor bore of a motor rotor and an aft journal bearing and a thrust bearing. As before, the thrust bearing, the forward journal bearing, and the aft journal bearing are foil bearings.

In a further aspect of the present invention, a method for operating an electrically-driven, two-stage vapor cycle compressor that includes an electric motor having a rotor supported by an aft journal bearing and a forward journal bearing, the rotor with an axial rotor bore, the compressor further having a forward end and an aft end; a first stage impeller positioned at the forward end of the compressor, a second stage impeller positioned at the forward end of the compressor, and a thrust disk supported by a thrust bearing, the method comprising the steps of: compressing a refrigerant vapor by means of a the first stage impeller and a the second stage impeller; extracting a first portion of the refrigerant vapor from a second stage impeller inlet; cooling the rotor bore and the aft journal bearing with the first portion of the refrigerant vapor; extracting a second portion of the refrigerant vapor from a second stage impeller outlet; and cooling the forward journal bearing with the second portion. The method may further comprise a step for cooling the thrust bearing with the second portion when the thrust disk is positioned between the motor and the second impeller and a step for cooling the thrust bearing with the first portion when the thrust disk is positioned at the aft end of the compressor.

These and other features, aspects and advantages of the present invention will become better understood with reference to the following drawings, description and claims.

DETAILED DESCRIPTION OF THE INVENTION

Figure 1:
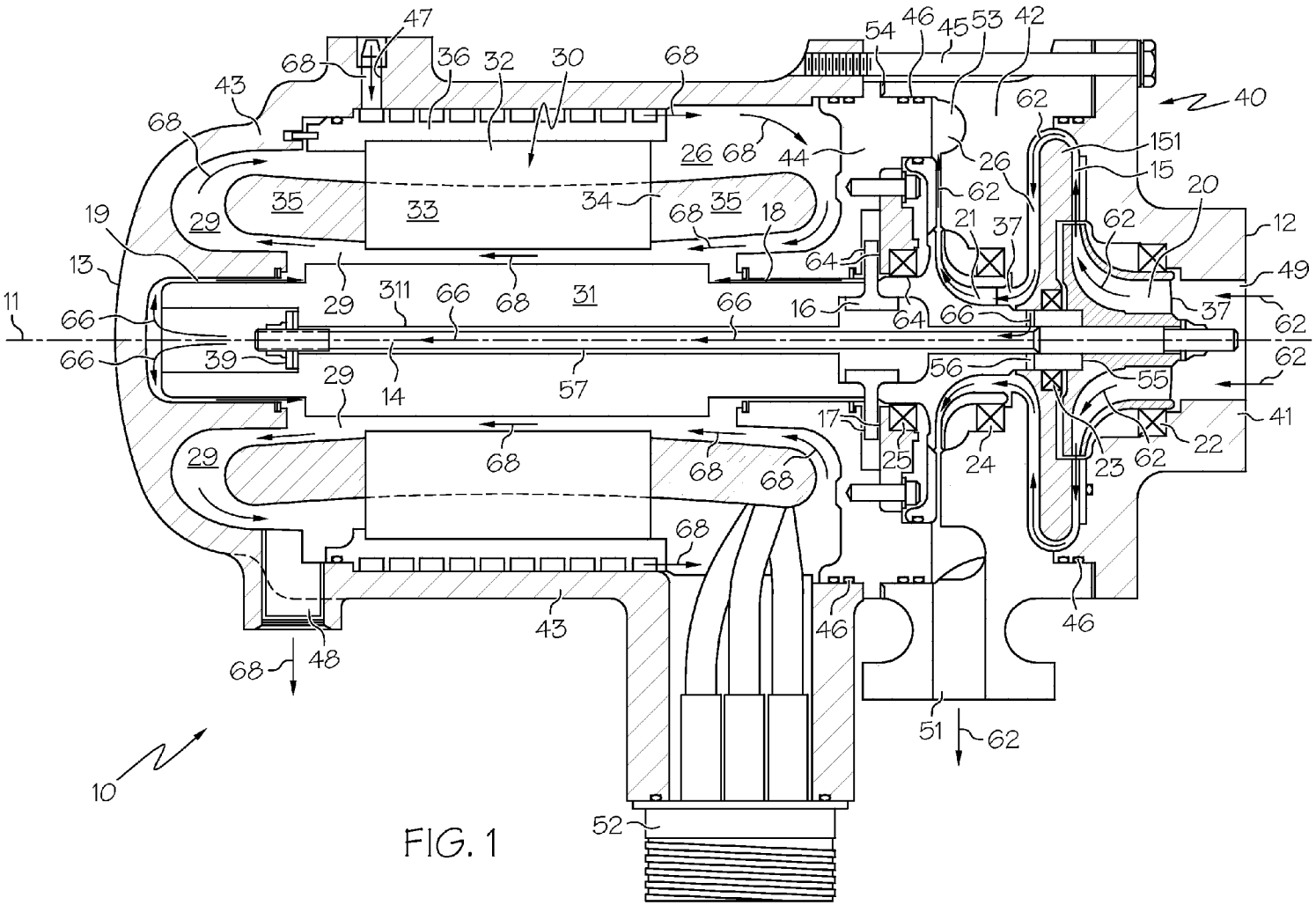
FIG. 1 is a simplified cross-sectional side view of a first embodiment of a two-stage vapor cycle compressor having a cooling jacket sleeve and a thrust disk situated between a motor and two impellers, according to an embodiment of the present invention.

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the present invention may provide a two-stage vapor cycle compressor and a method for vapor cooling an electrically driven two-stage vapor cycle compressor. In one embodiment, the present invention may provide a two-stage vapor cycle compressor that may be a relatively small and lightweight machine. The two-stage vapor cycle compressor according to one embodiment of the present invention may be gravity insensitive, and may withstand the environmental conditions of aerospace applications. In another embodiment, the present invention may provide a two-stage cycle compressor that has a simple layout, that may be relatively easy to assemble, and that has relatively low manufacturing costs. In still another embodiment, the present invention may provide a two-stage cycle compressor that enables compression of a refrigerant, such as a commercial CFC (chlorofluorocarbons)-free refrigerant, for example, R314a, at a relatively high speed with a relatively high efficiency. In still another embodiment, the present invention may provide a method for operating an electrically driven two-stage vapor cycle compressor that may enable cooling of the motor and the foil bearings efficiently and with exactly the right amount of refrigerant vapor to enable rotation of the impellers of the two-stage vapor cycle compressor at relatively high speed, for example, at about 50,000 rpm (rotations per minute) and above. The present invention may provide a two-stage vapor cycle compressor that is suitable for, but not limited to, applications in vapor compression refrigeration systems, such as air-conditioning systems, for example, in the aircraft and aerospace industries.

In contrast to the prior art, where vapor cycle compressors typically include a relatively high number of parts, the two-stage vapor cycle compressor according to the present invention may include a reduced number of parts by combining parts typically used separately, such as combining a first stage diffuser and a second stage inlet return channel plate or combining a second stage diffuser and a discharge scroll housing, and by taking advantage of modern high volume production techniques, such as pressure die-casting, investment casting, or injection molding. The two-stage vapor cycle compressor provided by the present invention may include a reduced number of interfaces, for example, by creating a compressor housing that may be formed by only three different housings, i.e. a motor housing, a scroll housing, and an inlet housing, all of which may be held together by a single row of bolts. Furthermore, by using cast aluminum or cast aluminum alloys, the housings of the compressor may be lightweight but may also have the thickness and strength as required for aerospace applications.

In further contrast to the prior art, where often foil bearings are used only for the journal bearings, the two-stage vapor cycle compressor provided by an embodiment of the present invention may include foil bearings for both the journal and the thrust bearings. Utilizing foil bearings for both the journal and the thrust bearings may enable the use of refrigerant vapor for cooling of these bearings and may eliminate water or oil contamination of the refrigerant, which may occur by using prior art oil or water cooled bearings, and may simplify the compressor layout. Furthermore, foil bearings may be high load capacity bearings that may withstand vibrations and shock environments found, for example, in aerospace applications. Also, by eliminating oil as a cooling medium for thrust and journal bearings, the operation of the two-stage vapor cycle compressor as in one embodiment of the present invention may be gravity insensitive.

In further contrast to the prior art, the present invention as in one embodiment may improve the aerodynamic performance and efficiency of the compressor compared to prior art compressors by utilizing a cast single-piece shrouded impeller for the first and second stage impeller and by applying a shimming concept for better alignment of the first and second impeller with the first and second diffuser, respectively. Using a single-piece shrouded impeller that may be a casting, as in one embodiment of the present invention, may minimize the internal leakage of each compression stage and, consequently, increase the efficiency of each compression stage. Also, casting the shrouded impeller for the first and second compression stage may cost less than fully machining the wheels and shroud contour and then brazing them together, as typically done in the prior art.

In further contrast to the prior art, where the motor cooling is typically separated from the bearing cooling, the vapor cycle compressor as in one embodiment of the present invention may include a cooling passageway that may enable cooling the journal bearing and the thrust bearing with the same cooling loop, where the refrigerant vapor for cooling may be extracted from the discharge of the second stage by bypassing a seal. The cooling passageway as in one embodiment of the present invention may further enable cooling the journal bearing and the motor rotor with the same cooling loop, where the refrigerant vapor for cooling may be extracted from the inlet of the second stage compressor and enters the rotor bore through an integrated cooling port instead of using prior art return channels and guide vanes that may add parts to the assembly and that may lower the efficiency of the bearing cooling. The cooling passageway as in one embodiment of the present invention may further include another cooling loop for cooling the electric motor. In contrast to the prior art where the electric motor may be cooled with a combination of liquid coolant and vapor refrigerant, the electric motor as in one embodiment of the present invention may be cooled entirely with a phase changing refrigerant, which may be the same refrigerant as compressed in the vapor cycle compressor and may be supplied from the condenser in liquid form. While the refrigerant may enter the motor cooling jacket in liquid form, it may turn to vapor form as it may be heated by the losses in the motor stator. The motor cooling refrigerant vapor may then, discharge into the internal motor cavities and may mix with the two bearing cooling loops before it may discharge from the vapor cycle compressor back to the evaporator. Typically, the cooling medium used for cooling bearings in the known prior art is not mixed with the cooling medium used for cooling the motor.

In further contrast to the prior art, where the cooling jacket comprises a separate assembly that must be inserted around the motor and into a housing, the invention provides an embodiment in which the cooling jacket cooling the motor may be integrally incorporated into an inner wall of the surrounding motor housing in such a way that the exterior surface of the motor forms a portion of the fluid passageway comprising the cooling jacket. This embodiment may further reduce parts count, weight, production cost, and size of the motor assembly, over the prior art, as well as provide a higher heat transfer efficiency through reduced sleeve head resistance.

Figure 3:
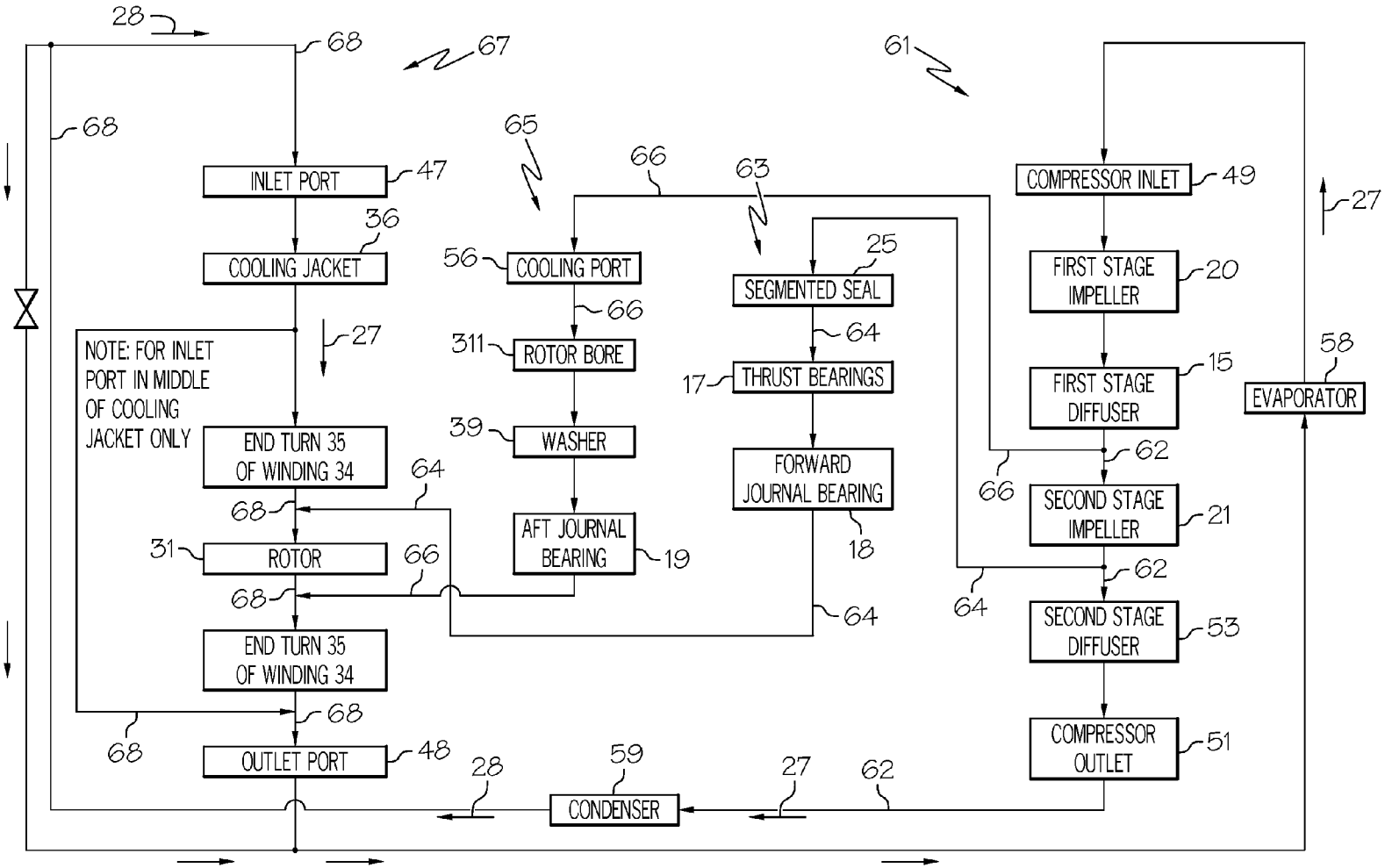
FIG. 3 is a simplified block diagram of an internal passageway of a two-stage vapor cycle compressor according to an embodiment of the present invention.

Referring now to FIG. 1, a simplified cross-sectional side view of a two-stage vapor cycle compressor 10 is illustrated according to an embodiment of the present invention. The compressor 10 may extend along a central axis 11 from a forward end 12 to an aft end 13. The compressor 10 may include a tie rod 14, a first stage impeller 20, a second stage impeller 21, a first stage diffuser 15, a diffuser plate 151, a thrust disk 16, an electric motor 30, and a compressor housing 40. The tie rod 14 may hold the entire rotating assembly of the compressor 10 including a rotor 31 of the electric motor 30, the first stage impeller 20, the second stage impeller 21, and the thrust disk 16 together. The tie rod 14 and, therefore, the first stage impeller 20 and the second stage impeller 21, as well as the thrust disk 16, may be driven by the electric motor 30, which may be a high power density electric motor, such as a high-speed alternating current multi-pole permanent magnet electric motor. The tie rod 14 may have a washer 39 installed at the circumference at one end proximate to the aft end 13 of the compressor 10. The washer 39 may allow a controlled amount of leakage of refrigerant vapor 27 (FIG. 3).

The electric motor 30 may be mounted on the tie rod 14 proximate to the aft end 13 of the compressor 10. The electric motor 30 may run on a pair of journal bearings 18 and 19, which may be foil bearings. Journal bearing 18 may be a forward journal bearing, while journal bearing 19 may be an aft journal bearing. Foil bearings 18 and 19 may use a flexible foil surface to maintain a film of vapor between the rotating tie rod 14 and the stationary bearing parts and may enable the electric motor 30 to run at speeds above about 50,000 rpm, for example, at speeds of about 75,000 rpm and above. The electric motor 30 may include a rotor 31 and a stator 32. The rotor 31 may include an axially extending bore 311 at the center for receiving the tie rod 14. The stator 32 may include an iron stack 33 and a winding 34. The winding 34 may include end turns 35. The electric motor 30 may be operated sensorless and, therefore, the speed of the electric motor 30 may not be determined by a speed sensor. Information about the rotational speed and position of the rotor 31 may be obtained from electromagnetic field data.

A cooling jacket 36 may be provided to remove excess heat from the iron stack 33 and the winding 34. In one embodiment, the cooling jacket 36 may formed as a generally cylindrical jacket having fluid passageways on its outer surface and into which the iron stack 33 may be radially piloted. The cooling jacket 36 containing the iron stack 33 along with the other associated motor components may in turn be contained within a protective motor housing 43 (described presently), so that the inner surface 60 of the motor housing 43 forms a portion of the fluid passageways. The cooling jacket 36 may be in direct contact with the outer diameter of the iron stack 33 of the stator 32. A variety of layouts may be used for the cooling jacket 36; for example, the cooling jacket 36 may be configured as a type of cooling jacket including a cooling jacket resistor as disclosed in U.S. patent application Ser. No. 11/555,645, hereby incorporated by reference.

In another embodiment (FIG. 1*a*), the cooling jacket 36 may be provided in the form of internal, helical annular grooves 50 that may be casted or machined into an inner surface 60 of the motor housing 43. A coolant fluid may be provided through an inlet port 47 that may be positioned as shown in FIG. 1 or at a midpoint of the cooling jacket 36. After entering the coolant passage through the inlet port 47, the coolant fluid stream may either be allowed to flow through the cooling jacket 36 as a single stream or to be split and circulated around the iron stack 33 in two opposite directions, according to two embodiments of the inlet port 47 as described. After absorbing heat from the iron stack 33, the coolant may be discharged into the motor housing 43 through two outlets in the helical groove. The coolant may then drained out through two draining ports on opposing ends of the motor.

Referring again to FIG. 1*a*, the iron stack 33 that forms the stator for the motor may be fabricated as an assembly comprised of a series of laminations assembly, according to the usual practices of the art. The iron stack 33 may be held in place within the motor housing 43 by the inwardly-extending edges of the passage vanes 152 by an interference fit. That is, the inner surface 60 of the motor housing 43 may be sized slightly smaller than the outside diameter of the iron stack 43 when at room temperature before installation. The motor housing 43 may be heated so that it may expand slightly, in order to allow a thermal fit when the iron core 43 is inserted into the heated motor housing 43 and the motor housing 43 is allowed to cool. The tips of the helical annular grooves 50 may evenly distribute the contact load to the stator laminates. This may make a shearing stress between the adjacent stator laminations small, so that the lamination, typically held together by the adhesion of a varnish coating the laminations, will not separate from the gripping force of the motor housing 43.

Figure 2:
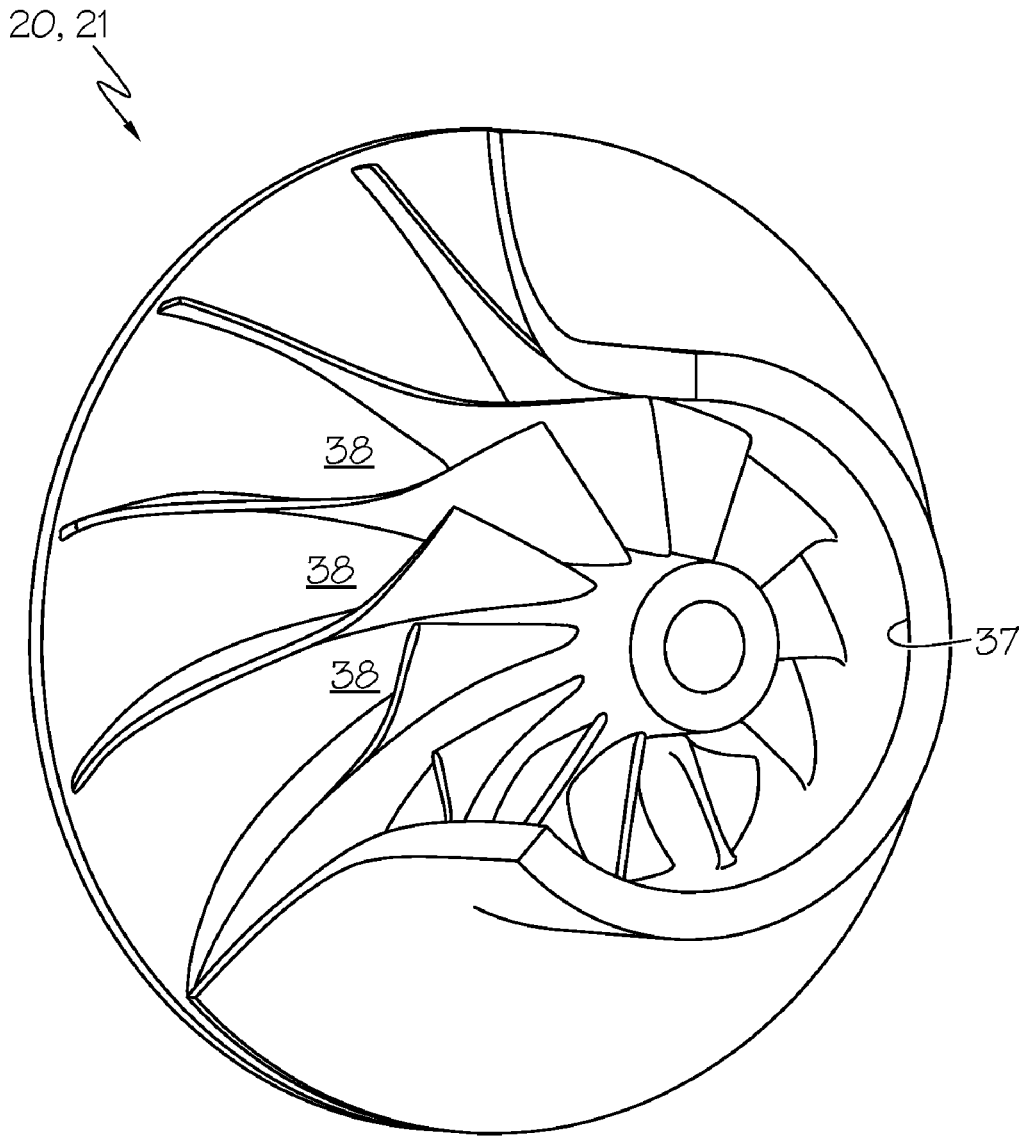
FIG. 2 is a perspective cut-away view of a shrouded impeller, according to an embodiment of the present invention.
Figure 2A:
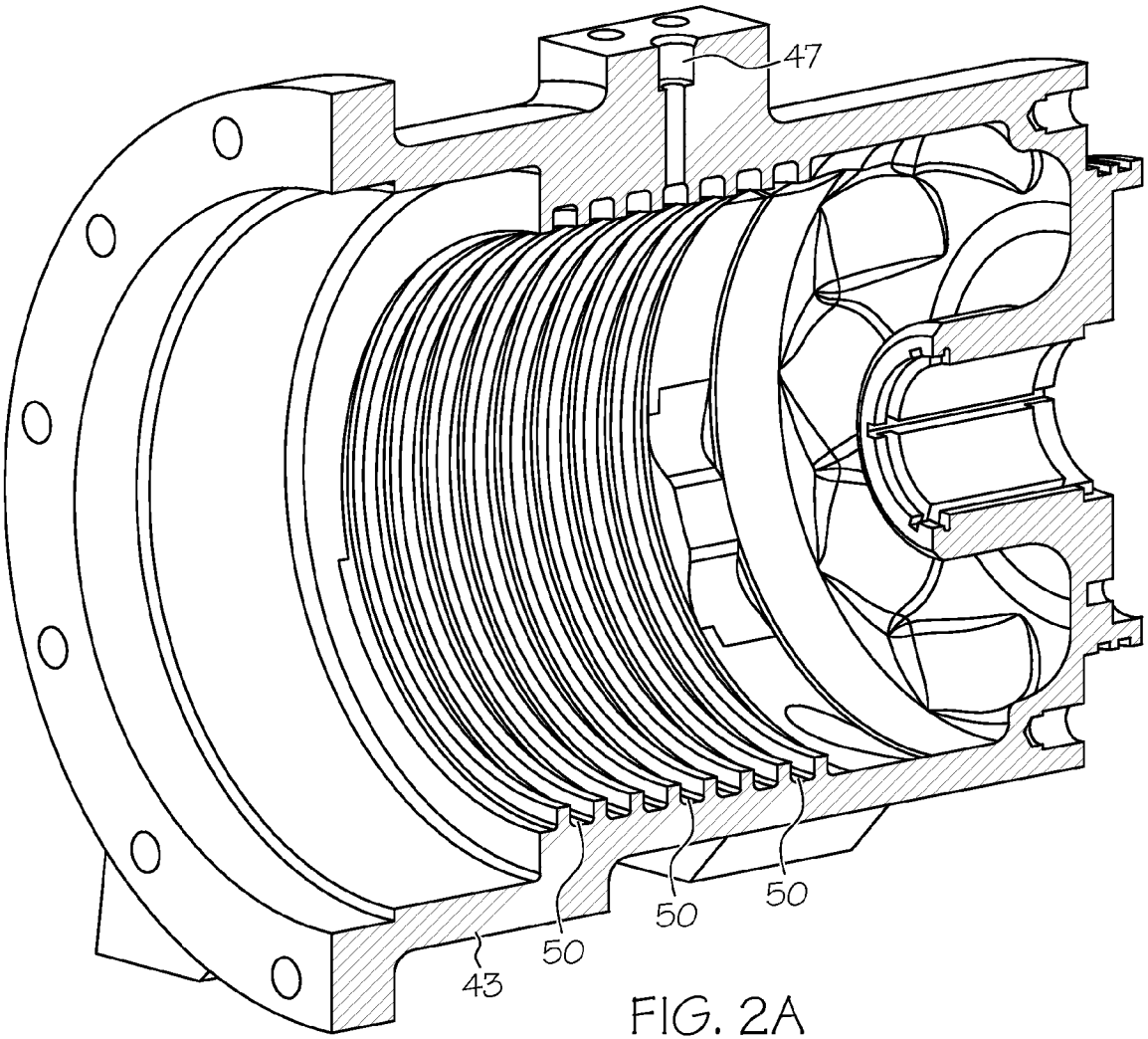
FIG. 2A is a perspective cut-away view of a motor housing having cooling channels fabricated in its inner surface, according to an embodiment of the present invention.
Figure 2B:
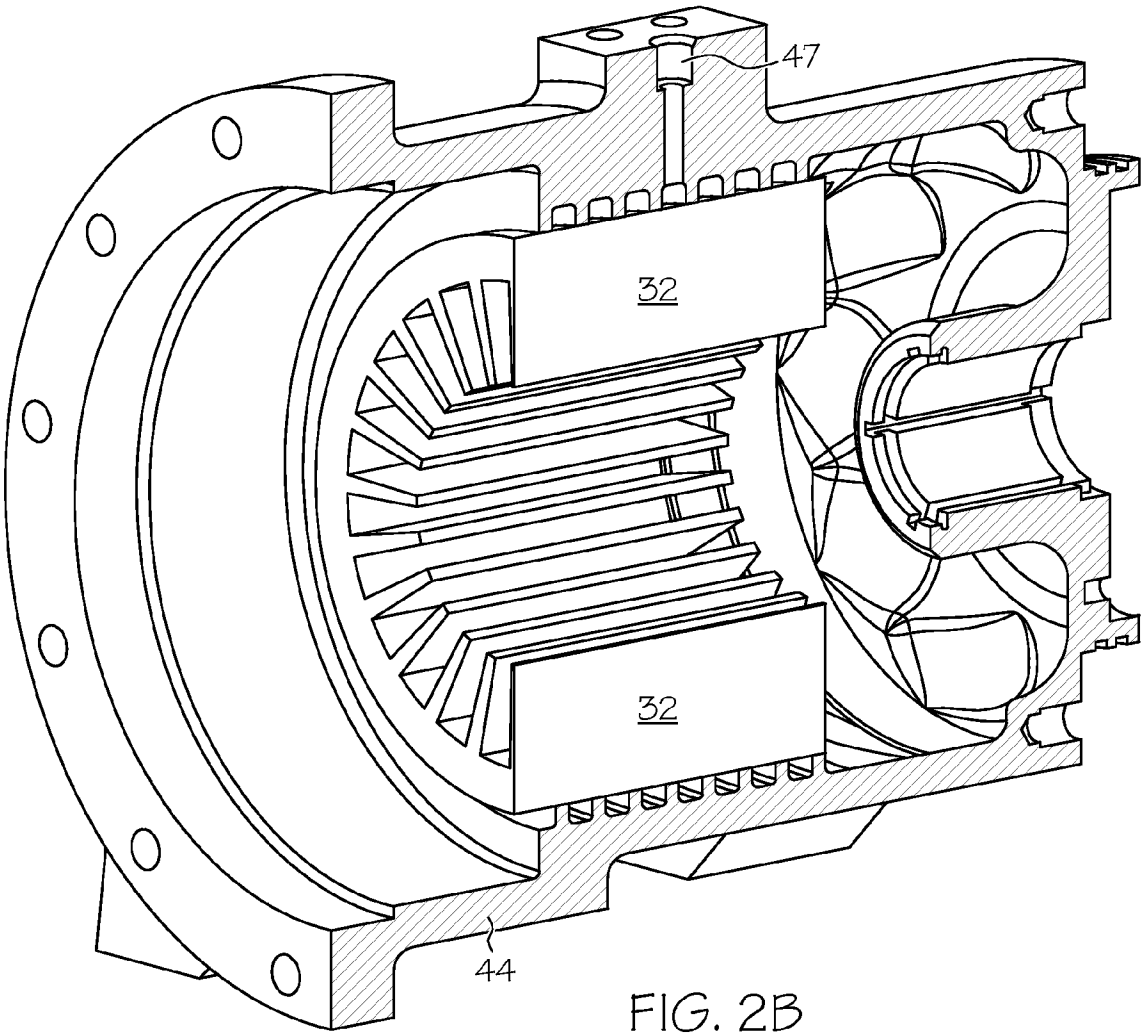
FIG. 2B is a perspective cut-away view of a motor housing having a stator of a motor inserted therein for cooling by the cooling channels fabricated in the inner surface of the motor housing, according to an embodiment of the present invention.

Referring again to FIG. 1, the first stage impeller 20 and the second stage impeller 21 may be configured in series and may be mounted on the tie rod 14 proximate to the forward end 12, opposite from the electric motor 30 and separated from the electric motor 30 by the thrust disk 16. The first stage impeller 20 and the second stage impeller 21 may be situated adjacent to each other thereby eliminating inter-stages cooling as often done in the prior art. The first stage impeller 20 and the second stage impeller 21 may be mounted on the tie rod 14 proximate to the forward end 12 of the compressor 10, at the opposite end from the electric motor 30, and may rotate with the tie rod 14. The tie rod 14 may function as a cantilever, which may be supported both transversely and rotationally at the end proximate to the aft end 13 by the electric motor 30 and the journal bearings 18 and 19 and which may be free to rotate at the opposite end where the first stage and second stage impeller 20 and 21, respectively, may be installed. The first stage diffuser 15 may be integrated into the first stage impeller 20 to minimize potential internal leakage. Furthermore, the first stage diffuser plate 151 may also be a second stage inlet return channel plate. The first stage impeller 20, as shown in detail in FIG. 2, and the second stage impeller 21 may have the same layout and size. The first stage impeller 20 and the second stage impeller 21 may have a diameter of about 2 inches. Both the first stage impeller 20 and the second stage impeller 21 may be shrouded for improved aerodynamic efficiency and to eliminate potential tip leakage. By using shrouded impellers 20 and 21, the entire flow 62 (FIG. 1) may pass through the blade channels 38 (FIG. 2). Both the first stage impeller 20 and the second stage impeller 21 may be single piece castings and may be manufactured from a cast aluminum or cast aluminum alloy during a pressure die-casting, an investment casting, or an injection molding process. Other cast materials suitable for aerospace applications may be used. The airfoil contours of the impellers 20 and 21 may be designed such that a casting tool may be pulled away from the casting after the casting process, allowing the impellers 20 and 21 to be manufactured as a single piece.

The thrust disk 16 may include two thrust bearings 17 positioned at opposite sides of the thrust disk 16. The thrust bearings 17 may control axial movement of the tie rod 14 relative to the compressor housing 40. The thrust bearings 17 may be foil bearings. Also, the position of the thrust disk 16 and the thrust bearings 17 may be chosen such that it may not interfere with the alignment of the impellers 20 and 21 with the first stage diffuser 15 and a second stage diffuser 53, respectively. As can be seen in FIG. 1, the thrust disk 16 may be positioned between the second stage impeller 21 and the electric motor 30. Compressor thrust loads may be additive and may be balanced against the thrust disk 16. Positioning the thrust disk 16 and the thrust bearings 17 between the second stage impeller 21 and the electric motor 30, and therefore, on the compressor side, may minimize axial misalignment due to differential thermal growth of the compressor housing 40 versus the rotor 31 of the electric motor 30 and may support high-speed operation of the compressor 10.

The compressor housing 40 may enclose the electric motor 30, the first stage impeller 20 and first stage diffuser 15, the second stage impeller 21 and second stage diffuser 53, the tie rod 14, and the thrust disk 16 and may include an inlet housing 41, a scroll housing 42, and a motor housing 43. The compressor housing 40 may be assembled with a single row of bolts 45. The inlet housing 41 may be positioned at the forward end 12 of the compressor 10 and may include a compressor inlet 49. The scroll housing 42 may be adjacent to and in direct contact with the inlet housing 41 and may include a compressor outlet 51. A second stage diffuser 53 may be incorporated within the scroll housing 42. The motor housing 43 may be positioned adjacent to the scroll housing 42 and may include an inlet port 47 and an outlet port 48. The inlet port 47 and the outlet port 48 may be positioned opposite each other on the circumference of the motor housing 43. The motor housing 43 may house the electric motor 30 and may also accommodate a hermetically sealed connector 52. The electric motor 30 may be installed within the motor housing 43 such that the outer diameter of the cooling jacket 36 may be in direct contact with the inner diameter of the motor housing 43. The inlet port 47 and the outlet port 48 may be in fluid connection with the cooling jacket 36. The inlet port 47 and the outlet port 48 may be positioned relative to the cooling jacket 36 such that a refrigerant may have the longest possible resident time in the compressor 10 to maximize the cooling effect. Shown in FIG. 1 are one inlet port 47 and one outlet port 48, but alternate configurations may include, for example, two outlet ports 48 positioned at opposite ends of the cooling jacket 36. It may further be possible to position the inlet port 47 at mid point of the cooling jacket 36 and enable a refrigerant to discharge on either side of the cooling jacket into internal cavities 29 of the electric motor 30. The aft journal bearing 19 may be integrated into the motor housing 43 proximate to the aft end 13 of the compressor. The inlet housing 41, the scroll housing 42, and the motor housing 43 may be connected with each other with a single row of bolts 45 and may form an outer housing, the compressor housing 40, of the compressor 10.

The compressor 10 may further include a bearing housing 44, which may be axially positioned between the second stage impeller 21 and the electric motor 30 and may be sandwiched between the scroll housing 42 and the motor housing 43. The bearing housing 44 may extend vertically to be in direct contact with motor housing 43 and the scroll housing 42. The bearing housing 44 may have the forward journal bearing 18 integrated and may accommodate the thrust disk 16. The bearing housing 44 may position the thrust disk 16 between the rotor 31 of the electric motor 30 and the second stage impeller 21.

Each housing, i.e., the inlet housing 41, the scroll housing 42, the motor housing 43, and the bearing housing 44, may be manufactured from cast aluminum and cast aluminum alloys during a pressure die-casting, investment casting, or injection molding process. Each housing, i.e. the inlet housing 41, the scroll housing 42, the motor housing 43, and the bearing housing 44, may be a single piece casting. Other cast materials suitable for aerospace applications may be used.

Double O-rings 46 may be installed at the interface between the bearing housing 44 and the motor housing 43. Double O-rings 46 may also be installed at the interface between the bearing housing 44 and the scroll housing 42.

Furthermore, double O-rings 46 may be installed at the interface between the inlet housing 41 and the scroll housing 42. The double O-rings 46 may not be limited to two O rings and may be multiple O-rings, where more than two O-rings may be installed at the mentioned interfaces. The double O-rings 46 may prevent leakage of refrigerant vapor 27 (FIG. 3) from the inside of the compressor 10 to the outside of the compressor 10. The double O-rings 46 may assist in hermetically sealing the compressor 10.

Shimming may be used for better alignment of the first stage impeller 20 and the second stage impeller 21 with the diffuser 15 and the scroll housing 42 including the second stage diffuser 53, respectively, which may be essential for the aerodynamic performance of the compressor 10. To enable high speed operation of the compressor 10, it may be critical to align the exit of the first stage impeller 20 and the inlet of the first stage diffuser 15 as well as the exit of the second stage impeller 21 and the inlet of the second stage diffuser 53 (incorporated in the scroll housing 42) as perfectly as possible. A shim 54 may be applied between the scroll housing 42 and the bearing housing 44 to meet dimensional requirements between the scroll housing 42 and the second stage impeller 21. A shim 55 may be applied between the first stage impeller 20 and the first stage diffuser 15. A shim may be a piece of a corrective material that may be applied as needed to meet dimensional requirements between the impellers 20 and 21 and the diffusers 15 and 53, respectively.

Four radial seals, i.e. seal 22, seal 23, seal 24, and seal 25, as shown in FIG. 1, may be installed within the compressor 10 to reduce internal leakages and improve the efficiency of the compressor 10. The seals 22, 23, 24, and 25 may be floating carbon ring seals or labyrinth seals. Seal 22 may be positioned proximate to an inlet 37 of the first stage impeller 20, seal 23 may be positioned proximate to an outlet of the first stage impeller 20, seal 24 may be positioned proximate to the inlet 37 of the second stage impeller 21, and seal 25 may be positioned proximate to an outlet of the second stage impeller 21. All seals 22, 23, 24, and 25 or some portion thereof may be segmented seals. While all seals 22, 23, 24, and 25 may exhibit some leakage of refrigerant vapor 27, a controlled amount of leakage from seal 25 may be permitted and used as a cooling flow regulation point to supply the thrust bearings 17 and the forward journal bearing 18 with a controlled flow of pressurized refrigerant vapor 27.

It should be noted that the previously described arrangement may be used to simultaneously cool all bearings, i.e. the thrust bearings 17, the forward journal bearing 18, and the aft journal bearing 19. However the principles used for cooling the bearings 17, 18, 19 with refrigerant vapor 27 may also be implemented on any single bearing or on any pair of the bearings without departing from the scope of the invention. It may also be used to cool foil bearings associated with additional obvious modifications that may be made to the compressor 10 without departing from the scope of the invention.

Referring now to FIG. 3, a simplified block diagram of an internal passageway 26 of a two-stage vapor cycle compressor 10 is illustrated according to an embodiment of the present invention. The inlet housing 41, the scroll housing 42, the motor housing 43, and the bearing housing 44 may define an internal passageway 26 of the compressor 10. The passageway 26 may be formed by open cavities inside the inlet housing 41, the scroll housing 42, the motor housing 43, and the bearing housing 44. At the same time, excess internal cavities or pockets where the liquid refrigerant 28 may potentially accumulate may be minimized by manufacturing the inlet housing 41, the scroll housing 42, the motor housing 43, and the bearing housing 44 as castings. Furthermore, the electric motor 30 may not employ a bore seal or any other kind of barrier between the rotor 31 and the stator 32. Therefore, internal motor cavities 29 may exist within the rotor 31 and stator 32 assembly of the electric motor 30, such as a wide gap between the rotor 31 and the stator 32. The internal motor cavities 29 may be part of the passageway 26 and may enable efficient cooling the rotor 31 and the stator 32.

A refrigerant in vapor form, refrigerant vapor 27, may travel within the passageway 26 through the interior of the compressor 10. The same refrigerant emerging from the condenser 59 in liquid form, liquid refrigerant 28 may be split into two fractions. The main fraction of it may be sent to the evaporator 58 through the throttle valve and the minor fraction may be provided to the inlet port 47 where it may enter the cooling jacket 36 of the electric motor 30. The refrigerant, in vapor form 27 and in liquid form 28, may be, for example, a commercial CFC (chlorofluorocarbons)-free refrigerant, such as R314a. The refrigerant, in vapor form 27 and in liquid form 28, may be the only refrigerant that may be used throughout the compressor 10 for the two-stage compression and the cooling of the electric motor 30, the journal bearings 18 and 19, and the thrust bearings 17. The passageway 26 may be divided into four different but interconnected refrigerant flow loops, as follows: (1) a compression loop 61; (2) a forward cooling loop 63; (3) an aft cooling loop 65; and (4) a motor cooling loop 67. The refrigerant vapor 27 may flow within the compression loop 61 in the direction of the arrows 62. The refrigerant vapor 27 may flow within the forward cooling loop 63 in the direction of the arrows 64. The refrigerant vapor 27 may flow within the aft cooling loop 65 in the direction of the arrows 66. The liquid refrigerant 28 at first and then the refrigerant vapor 27 may flow within the motor cooling loop 67 in the direction of the arrows 68. The passageway 26 and the arrows 62, 64, 66, and 68 indicating the flow direction within the loops 61, 63, 65, and 67, respectively, are also shown in FIG. 1.

Figure 1A:
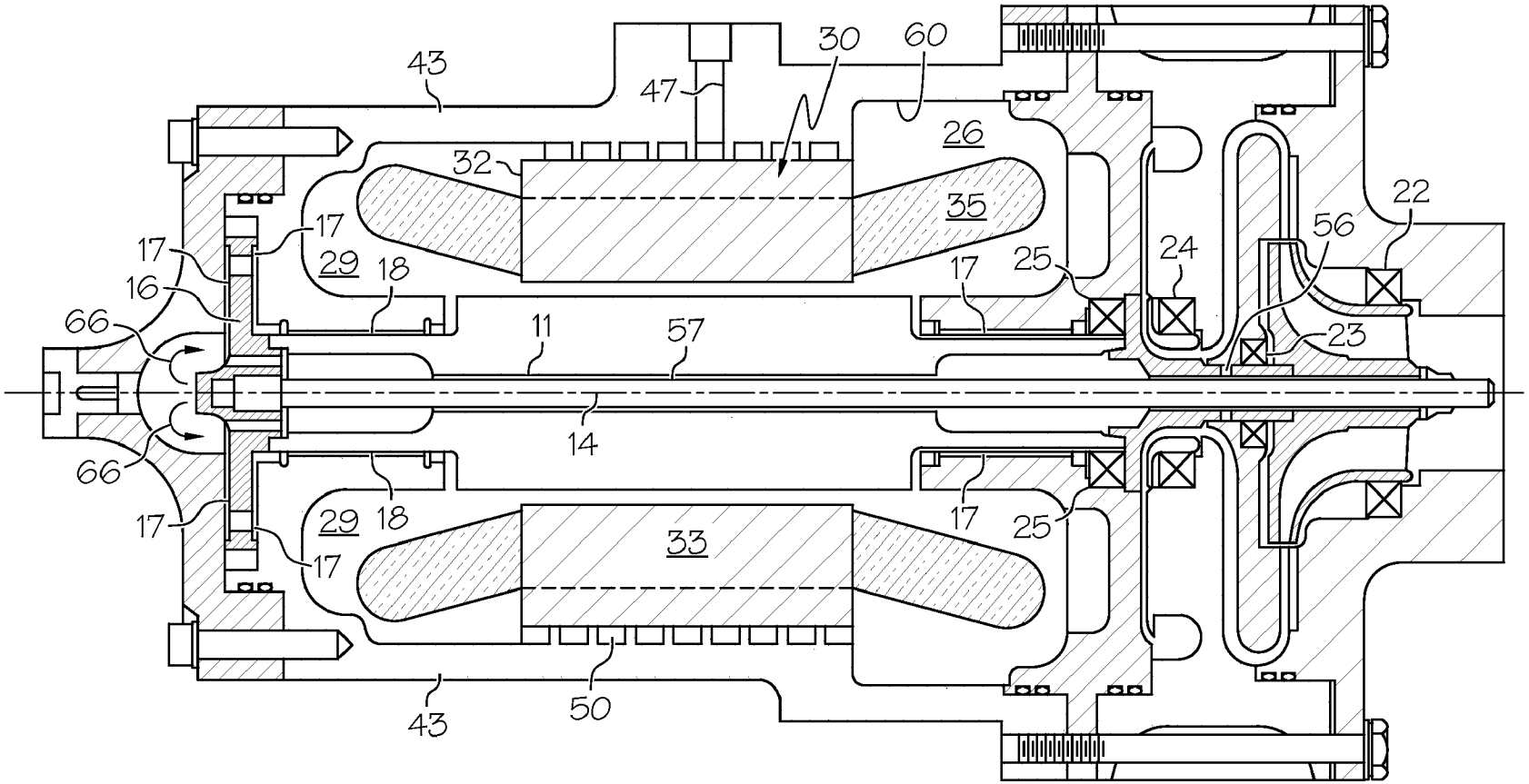
FIG. 1A is a simplified cross sectional side view of a second embodiment of a two-stage vapor cycle compressor, illustrating a cooling jacket that is fabricated in an inner wall of a motor housing and a thrust disk situated at an aft end of the compressor, according to the present invention.

Referring now to FIGS. 1, 1*a*, and 3, the compression loop 61 may now be described. The refrigerant vapor 27 may enter the compression loop 61 of the compressor 10 by axially entering the compressor inlet 49. At this point the refrigerant vapor 27 may have a relatively low pressure and a relatively low temperature and may come from an evaporator 58. The refrigerant vapor 27 may be ducted through the compressor inlet 49 to axially enter the first stage impeller 20 at an inlet 37. The refrigerant vapor 27 may flow entirely through the blade channels 38 (FIG. 2) of the first stage impeller 20 and exit radially. The refrigerant vapor 27 may then travel within the passageway 26 formed between the first stage diffuser blade 151 and the inlet housing 41 and scroll housing 42, as shown by arrows 62. The refrigerant vapor 27 may travel around the diffuser blade 151, so that it is axially directed into the inlet 37 of the second stage impeller 21. The refrigerant vapor 27 may flow entirely through the blade channels 38 (FIG. 2) of the second stage impeller 21. The refrigerant vapor 27 may exit the second stage impeller 21 radially and may travel within the passageway 26 through the second stage diffuser 53 incorporated within the scroll housing 42. The refrigerant vapor 27, which may now have a relatively high pressure and a relatively high temperature, may exit the compressor 10 through the compressor outlet 51 and may travel toward a condenser 59.

The aft cooling loop 65 may now be described. A cooling port 56 proximate to the inlet 37 of the second stage impeller 21 may allow a portion of the refrigerant vapor 27 flowing in the compression loop 61 to be extracted and enter the aft cooling loop 65 by flowing in the direction of the arrows 66. The refrigerant vapor 27 may enter a space 57 between the tie rod 14 and the circumference of the bore 311. The cooling port 56 and the space 57 may be considered as part of the passageway 26. The refrigerant vapor 27 may travel axially in the direction of the arrows 66 within the space 57 toward the aft end 13 of the compressor 10 thereby cooling the bore 311. In the case where the thrust disk 16 is situated at the forward end 12 of the compressor 10 between the electric motor 30 and the impellers 20, 21 (FIG. 1), the refrigerant vapor 27 may exit the space 57 through the washer 39 and may flow over the aft journal bearing 19 as indicated by arrows 66, thereby cooling the journal bearing 19 before merging with the refrigerant vapor 27 traveling within the motor cooling loop 67. In the case where the thrust disk 16 is situated at the aft end 13 of the compressor 10 (FIG. 1*a*), the refrigerant vapor 27 may exit the space 57 and may flow over the thrust bearings 17 and the aft journal bearing 19 as indicated by arrows 66, thereby cooling both bearings before merging with the refrigerant vapor 27 traveling within the motor cooling loop 67.

The forward cooling loop 63 may now be described. After exiting the second stage impeller 21, a portion of the refrigerant vapor 27 flowing in the compression loop 61 may be extracted from the discharge of the second stage impeller 21, may bypass the segmented seal 25 positioned at an outlet of the second stage impeller 21, and may enter the forward cooling loop 63 by flowing in the direction of the arrows 64. In the case where the thrust disk 16 is situated at the forward end 12 of the compressor 10 between the electric motor 30 and the impellers 20, 21 (FIG. 1), the refrigerant vapor 27 may first flow over the two thrust bearings 17 and then over the forward journal bearing 18 in the direction of the arrows 64, thereby cooling the thrust bearings 17 and the journal bearing 18. In the case where the thrust disk 16 is situated at the aft end 13 of the compressor 10 (FIG. 1*a*), the refrigerant vapor 27 may flow over the forward journal bearing 18 in the direction of the arrows 64, thereby cooling the forward journal bearing 18. In either case, the refrigerant vapor 27 flowing in the forward cooling loop 63 may then merge with the refrigerant vapor 27 flowing in the motor cooling loop 67.

The motor cooling loop 67 may now be described. Liquid refrigerant 28, which may be extracted from the condenser 59, may enter the electric motor 30 cooling loop 67 and the cooling jacket 36 through the inlet port 47. In an embodiment where the inlet port 47 is located at an end of the cooling jacket 36, the liquid refrigerant 28 may heat up by the losses in the stator 32 while moving along the cooling jacket 36 and may take on vapor form. The refrigerant vapor 27 may continue to travel through the cooling jacket 36 thereby cooling the iron stack 33 and partially cooling the winding 34 of the stator, but may also discharge to internal motor cavities 29. By flowing along the passageway 26, which may lead through the internal motor cavities 29, in the direction of the arrows 68, the refrigerant vapor 27 may cool the end turns 35 of the winding 34 and the rotor 31. The refrigerant vapor 27 flowing in the motor cooling loop 67 may merge with the refrigerant vapor 27 flowing out of the forward cooling loop 63 (described previously) prior to flowing over the rotor 31. The refrigerant vapor 27 flowing in the motor cooling loop 67 may also merge with the refrigerant vapor 27 flowing out of the aft cooling loop 65. The combined refrigerant vapor 27 may exit the motor cooling loop 67 and the compressor 10 through the outlet port 48. After leaving the motor cooling loop 67 through outlet port 48, the discharged refrigerant vapor 27 may then mix with the main refrigerant vapor 28 from throttle valve and travel to the evaporator 58. In an embodiment where the inlet port 47 is located proximate a midpoint of the cooling jacket 36 (FIG. 1*a*), the refrigerant vapor 27 may flow from either end of the cooling jacket 36. Thus a fraction of the refrigerant vapor 27 may flow directly to the outlet port 48 from one end of the cooling jacket 36 and the refrigerant vapor 27 flowing from the other end of the cooling jacket 36 may flow along the path described before.

Figure 4:
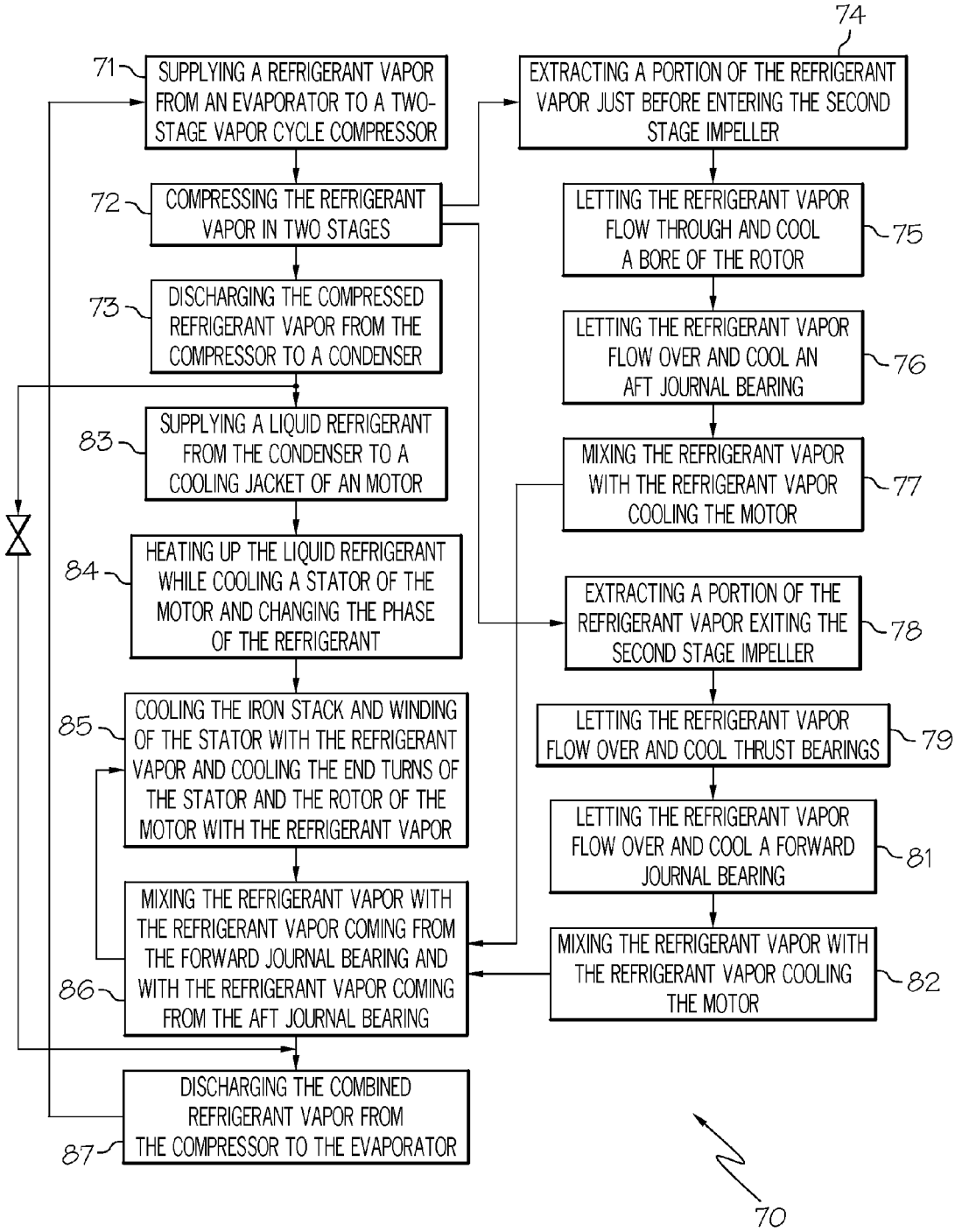
FIG. 4 is a flow chart representing a method for operating an electrically driven two-stage vapor cycle compressor according to an embodiment of the present invention.

Referring now to FIGS. 1 and 4, a flow chart representing a method 70 for operating an electrically driven two-stage vapor cycle compressor 10 is illustrated according to an embodiment of the present invention. The method 70 may involve a step 71 where a refrigerant vapor 27 having a relatively low pressure and a relatively low temperature is supplied from an evaporator 58 to a two-stage vapor cycle compressor 10. A step 72 may involve compressing the refrigerant vapor 27 in two stages by letting the refrigerant vapor 27 flow through a first stage impeller 20 followed by a first stage diffuser 15 and then through a second stage impeller 21 followed by a second stage diffuser 53. In a step 73 the compressed refrigerant vapor 27, now having a relatively high pressure and a relatively high temperature, may be discharged from the compressor 10 to a condenser 59. After the compressed refrigerant vapor 27 is discharged from the condenser 59 as a refrigerant liquid 28, it may be split into two fractions, with the main fraction being passed to the throttle valve and the minor fraction being passed to the cooling jacket 36 (step 83).

A step 74 may involve extracting a portion of the refrigerant vapor 27 from the refrigerant vapor 27 entering the second stage impeller 21, and therefore from the inlet to the second stage. In a following step 75, the extracted portion of the refrigerant vapor 27 may flow through and cool a bore 311 of a rotor 31. In a following step 76, the extracted portion of the refrigerant vapor 27 may exit the bore 311 through a washer 39 and may flow over and cool an aft journal bearing 19. A step 77 may involve mixing the extracted portion of the refrigerant vapor 27 with the refrigerant vapor 27 cooling the stator 32 and the rotor 31 of the electric motor 30.

A step 78 may involve extracting a portion of the refrigerant vapor 27 from the refrigerant vapor 27 exiting the second stage impeller 21, and therefore from the second stage discharge. In a following step 79, the extracted portion of the refrigerant vapor 27 may flow over and cool thrust bearings 17. In a following step 81, the extracted portion of the refrigerant vapor 27 may flow over and cool a forward journal bearing 18. A step 82 may involve mixing the extracted portion of the refrigerant vapor 27 with the refrigerant vapor 27 cooling the stator 32 and the rotor 31 of the electric motor 30.

A step 83 may involve supplying a liquid refrigerant 28 from the condenser 59 to a cooling jacket 36 of an electric motor 30 that rotates the first stage and second stage impeller 20 and 21, respectively. In a step 84, the liquid refrigerant 28 may heat up from the heat developed by the electric motor 30 while cooling the iron stack 33 and partially cooling the winding 34 of a stator 32 and may change phase taking on vapor form. In a step 85, the refrigerant vapor 27 may continue to flow in the cooling jacket 36 and to cool the stator 32 but may also enter internal motor cavities 29 and may cool the end turns 35 of the winding 34 and the rotor 31. A step 86 may involve mixing the refrigerant vapor 27 cooling the rotor 31 and stator 32 of the electric motor 30 with the extracted portions of the refrigerant vapor 27 coming from the forward journal bearing 18 and from the aft journal bearing 19. In a step 87 the combined refrigerant vapor 27 may continue to cool the stator 32 and the rotor 31. A step 87 may involve discharging the combined refrigerant vapor 27 from the compressor 10 to the evaporator 58. Additionally, the refrigerant vapor 27 from the throttle value may be merged at this point and passed to the evaporator 58.

The method 70 described previously may also be applied to an embodiment in which the thrust disk 16 is situated at the aft end 13 of the compressor 10. Referring now to FIGS. 1*a* and 4, the method 70 may be identical with the method described for the embodiment shown in FIG. 1, with the exception that cooling for the thrust bearings may now occur in step 76 instead of in step 79, and step 79 may be eliminated.

Application of method 70 may enable compression of a refrigerant, such as a commercial CFC (chlorofluorocarbons)-free refrigerant, for example, R314a, at a relatively high speed. Method 70 may facilitate cooling the electric motor 30 and the foil bearings 17, 18, and 19 efficiently and with just the right amount of refrigerant vapor 27 to enable rotation of the impellers 20 and 21 of the two-stage vapor cycle compressor 10 at relatively high speed, for example, at about 50,000 rpm and above. The method 70 may further apply with obvious modifications for the cooling of any combination of the foil bearings 17, 18, and 19, the bearings either taken individually, two at a time, or all bearings taken collectively, as has been previously described.

It should be understood, of course, that the foregoing relates to exemplary embodiments of the invention and that modifications may be made without departing from the spirit and scope of the invention as set forth in the following claims.

We claim:

1. A two-stage vapor cycle compressor, comprising:

a first stage impeller with a first stage impeller inlet receiving a refrigerant vapor for compression by the first stage impeller, the first stage impeller with a first stage impeller outlet providing a compressed refrigerant vapor;

a second stage impeller with a second stage impeller inlet receiving the compressed refrigerant vapor from the first stage impeller outlet for compression by the second stage impeller, the second stage impeller further having a second stage impeller outlet;

a motor having a rotor running on forward and aft foil journal bearings, the motor driving the first stage impeller and the second stage impeller;

a thrust disk with a foil thrust bearing, the thrust disk attached to the rotor of the motor; and a compressor housing enclosing the first stage impeller, the second stage impeller, and the motor, the compressor housing with a compressor inlet receiving the refrigerant vapor and directing the refrigerant vapor to the first stage impeller inlet;

a first cooling loop connecting a hollow interior of the rotor with an input of the second stage impeller so that a first portion of refrigerant vapor at a first stage of compression passes through the rotor to partially cool the rotor and the aft journal bearing;

a second cooling loop connecting an output of the second stage impeller with the forward journal bearing so that a second portion of the refrigerant vapor passes through the forward journal bearing to partially cool the forward journal bearing;

wherein the compressor housing further comprises:

an inlet for liquid refrigerant, the inlet connected to a motor-stator cooling jacket, the motor-stator cooling jacket being configured to transfer heat from the stator to the liquid refrigerant and vaporize the liquid refrigerant into a third portion of cooling refrigerant vapor so that the stator is cooled;

a passageway connecting the motor-stator cooling jacket with the journal bearings, the thrust bearing and the rotor so that the third portion of vaporized refrigerant combines with the first and second portions of the cooling refrigerant vapor to produce further cooling of the rotor, the journal bearings and the thrust bearing.

2. The two-stage vapor cycle compressor of claim 1, further comprising a first stage diffuser integrated into the first stage impeller, and a second stage diffuser integrated into the compressor housing, wherein the first stage diffuser has a diffuser plate, and the diffuser plate is also a second stage inlet return channel plate.

3. The two-stage vapor cycle compressor of claim 1, wherein said compressor housing comprises:

an inlet housing constructed as a single piece casting that forms the compressor inlet;

a scroll housing constructed as a single piece casting with a second stage diffuser formed therein, the second stage impeller positioned within the second stage diffuser, the scroll housing forming the compressor outlet, the scroll housing positioned adjacent to and in direct contact with the inlet housing; and a motor housing constructed as a single piece casting having an inlet port, an outlet port, and an inner surface, the inner surface having helical annular grooves with edges formed therein to function as a cooling jacket about the motor, the motor housing having the journal bearing integrated within the motor housing, the motor housing positioned adjacent to the scroll housing with the edges of the helical annular grooves being in direct contact with and about the motor.

4. The two-stage vapor cycle compressor of claim 1, further including:

a first stage diffuser;

the compressor housing comprising a scroll housing with a second stage diffuser formed therein for positioning about the second stage impeller;

a first shim, and a second shim;

wherein said first shim aligns first stage impeller outlet with an inlet of the first stage diffuser; and the second shim aligns the second stage impeller outlet with an inlet of said second stage diffuser.

5. The two-stage vapor cycle compressor of claim 4, further including four radial seals each positioned proximate to the first stage impeller inlet, the first stage impeller outlet, the second stage impeller inlet, and the second stage impeller outlet, respectively, wherein said radial seal proximate to the second stage impeller outlet is a segmented seal allowing a controlled flow of the compressed refrigerant vapor to pass therethrough and lubricate the bearings.

6. The two-stage vapor cycle compressor of claim 1, further including a plurality of multiple 'O'-rings, wherein said multiple 'O'-rings prevent leakage of said refrigerant vapor from an inside of said compressor to an outside of said compressor.

7. The two-stage vapor cycle compressor of claim 1 wherein the motor-stator cooling jacket comprises a jacket inner surface and a jacket outer surface, the jacket outer surface being in direct contact with an inner surface of a motor housing, the cooling jacket having fluid passageways on the jacket outer surface, the cooling jacket receiving the motor therein, wherein the motor is in direct contact with the jacket inner surface.

8. A refrigerant flow passageway of a two-stage vapor cycle compressor, the compressor comprising a motor with a rotor rotating about an axially positioned tie rod supported by a forward journal bearing and an aft journal bearing, the tie rod having axially mounted thereon a thrust disk, a second stage impeller, and a first stage impeller, the first stage impeller receiving and compressing a refrigerant vapor, the second stage impeller situated adjacent to the first stage impeller and receiving and compressing the refrigerant vapor from the first stage impeller, the thrust disk having a thrust bearing, the compressor further having a compressor housing enclosing the first stage impeller, the second stage impeller, the thrust disk, and the motor, the compressor housing with a compressor inlet to receive the refrigerant vapor and direct the refrigerant vapor to the first stage impeller, the compressor housing having a compressor outlet to direct the refrigerant vapor from the second stage impeller, the passageway comprising:

a compression loop compressing the refrigerant vapor, the compression loop including a first stage a second stage;

a forward cooling loop, wherein a first cooling portion of the refrigerant vapor received from the first stage of the compression loop is directed to flow over and partially cool the thrust bearing and the forward journal bearing; and an aft cooling loop, wherein a second cooling portion of the refrigerant vapor from the first stage of the compression loop is directed to flow through and partially cool a rotor bore of the rotor and the aft journal bearing;

a motor cooling loop connected to the forward cooling loop and the aft cooling loop wherein a third cooling portion of the refrigerant vapor is produced from liquid refrigerant by heat transfer from a stator of the motor;

wherein the thrust bearing, the forward journal bearing, and the aft journal bearing are foil bearings which are further cooled by a mixture of the first, second and third cooling portions of the refrigerant vapor.

9. The passageway of claim 8, wherein:

the first cooling portion of the refrigerant vapor from the compression cooling loop is received through a segmented seal positioned proximate to the outlet of the second stage impeller;

the second cooling portion of the refrigerant vapor from the compression cooling loop is received through a cooling port positioned proximate to the inlet of the second stage impeller.

10. The passageway of claim 8, further including:

the compressor housing including an inlet housing, a scroll housing, and a motor housing, wherein the motor housing accommodates the electric motor and the aft journal bearing, wherein the inlet housing and the scroll housing accommodate the first stage and the second stage impeller;

a bearing housing, wherein the bearing housing is sandwiched between the scroll housing and the motor hosing and extends vertically to be in direct contact with the motor housing and the scroll housing, wherein the bearing housing is axially positioned between the second stage impeller and the electric motor, and wherein the bearing housing accommodates the forward journal bearing and the trust bearings; and wherein open cavities within the compressor housing and the bearing housing form the passageway.

11. The passageway of claim 10, wherein the inlet housing, the scroll housing, the motor housing, and the bearing housing are aluminum or aluminum alloy castings.

12. A method for operating an electrically-driven, two-stage vapor cycle compressor that includes an electric motor having a rotor supported by an aft foil journal bearing and a forward foil journal bearing, the rotor with an axial rotor bore, the compressor further having a forward end and an aft end; a first stage impeller at the forward end of the compressor, a second stage impeller at the forward end of the compressor, and a thrust disk supported by a foil thrust bearing, the method comprising the steps of:

compressing a refrigerant vapor by means of the first stage impeller and the second stage impeller;

extracting a first cooling portion of said refrigerant vapor from a second stage impeller inlet;

partially cooling the rotor bore and the aft journal bearing with the first cooling portion of the refrigerant vapor;

extracting a second cooling portion of the refrigerant vapor from a second stage impeller outlet; and partially cooling the forward foil journal bearing with the second cooling portion heating up a liquid refrigerant with heat extracted by partially cooling the electric motor;

changing the phase of the liquid refrigerant to provide a third cooling portion of the refrigerant vapor;

mixing the third portion with the first and second portions; and further cooling the electric motor and the forward and aft foil journal bearings with a mixture of the first, second and third cooling portions of the refrigerant vapor.

13. The method of claim 12, further including the steps of:

providing the compressor with the refrigerant vapor from an evaporator;

discharging the refrigerant vapor from the compressor to a condenser after compression;

cooling the compressor with the liquid refrigerant from the condenser;

directing the liquid refrigerant supplied by the condenser through a cooling jacket, wherein the cooling jacket is positioned between and in direct contact with an iron stack and a housing of the electric motor;

cooling the iron stack and partially cooling a winding of the electric motor with the liquid refrigerant and with the third portion of the refrigerant vapor;

cooling winding end turns of the electric motor and the rotor with the first, second, and third portions of the refrigerant vapor; and discharging the first, second, and third portions of the refrigerant vapor to the evaporator.

14. The method of claim 12, further including the steps of:

casting as a single piece casting an item selected from a group consisting of a motor housing that accommodates both the electric motor and the aft journal bearing, a scroll housing, an inlet housing, a bearing housing that accommodates both the thrust bearing and the forward journal bearing, the first stage impeller, and the second stage impeller;

manufacturing each selected item using a process selected from a group consisting of pressure die-casting, investment casting, and injection molding; and forming a passageway for the refrigerant vapor to travel through the motor housing, the scroll housing, the inlet housing, and the bearing housing.

* * * * *